US005728460A

United States Patent [19]

Hirasawa et al.

[11] Patent Number: 5,728,460

[45] Date of Patent: Mar. 17, 1998

[54] REINFORCING TAPES FOR SLIDE FASTENER

[75] Inventors: Masanori Hirasawa, Kurobe; Osamu Fujii, Namerikawa; Shigeru Funakawa, Toyama-ken; Toyoo Morita, Uozu; Kazuki Kuse, Toyama, all of Japan

[73] Assignee: YKK Corporation, Tokyo, Japan

[21] Appl. No.: 638,180

[22] Filed: Apr. 26, 1996

[30] Foreign Application Priority Data

Apr. 29, 1995 [JP] Japan ..... 7-141028

[51] Int. Cl.[6] ..... C09J 7/02; A44B 19/24; A44B 19/42

[52] U.S. Cl. ..... 428/349; 24/433; 24/434; 156/220

[58] Field of Search ..... 428/343, 349, 428/156; 24/433, 434; 156/220

[56] References Cited

U.S. PATENT DOCUMENTS

| | | | |
|---|---|---|---|
| 3,663,996 | 5/1972 | Heimberger | 24/205.11 |
| 4,138,771 | 2/1979 | Manning . | |
| 4,651,389 | 3/1987 | Yoshida | 24/433 |
| 5,231,737 | 8/1993 | Frohlich | 24/434 |

FOREIGN PATENT DOCUMENTS

| | | |
|---|---|---|
| 0 336 347 | 10/1989 | European Pat. Off. . |
| 1 429 354 | 1/1966 | France . |
| 44-25843 | 10/1969 | Japan . |
| 62-149780 | 7/1987 | Japan . |
| 1 507 915 | 4/1978 | United Kingdom . |
| 2 166 488 | 5/1986 | United Kingdom . |

OTHER PUBLICATIONS

Derwent Patent Abstrat for Japanese JP6079830.

*Primary Examiner*—Jenna Davis
*Attorney, Agent, or Firm*—Hill, Steadman & Simpson

[57] ABSTRACT

A slide fastener comprises a pair of dyed fastener tapes each having a row of coupling elements attached to the fastener tape along a longitudinal edge thereof and at least a pair of reinforcing tapes attached to a terminal part of each of the fastener tapes. The reinforcing tape comprising a transparent elastomer film and an adhesive layer superposed on the reverse side of the elastomer film is attached by welding or fusion bonding to the terminal part of the dyed fastener tape through the medium of the adhesive layer and has a knurled surface at the welded part.

5 Claims, 2 Drawing Sheets

REINFORCING TAPES FOR SLIDE FASTENER

BACKGROUND OF THE INVENTION

1. Field of the Invention

This invention relates to separable slide fasteners and more particularly to reinforcing tapes to be applied fast to the terminal parts of the fastener tapes, particularly the terminal parts of dyed fastener tapes, to which a separable insertion joint is attached. This invention further relates to a method for forming fastener tapes having a reinforced terminal part.

2. Description of the Prior Art

The conventional reinforcing tapes to be applied fast to the terminal parts of dyed fastener tapes have included those which, for the sake of obviating the necessity of preparing reinforced tapes dyed specially in various colors matched to the colors of the aforementioned dyed fastener tapes and consequently saving such time and labor as would otherwise be incurred in the inventory control, use transparent synthetic resin films in a superposed manner so as to show the colors of the dyed fastener tapes therethrough. For example, the reinforcing pieces which are formed of two superposed transparent synthetic resin films having different melting points and are adapted to be applied fast to fastener tapes by melting that of the two films having a lower melting point as disclosed in Japanese Utility Model Publication No. 44-25, 843 and the lateral application tapes which are formed by superposing on one side of a transparent film of nylon 6 or nylon 6,6 a transparent polyester copolymer film having a melting point in the range of 80° to 200° C. so as to show the color of the base fabric of fastener tapes therethrough as disclosed in published Japanese Patent Application, KOKAI (Early Publication) No. 62-149,780 have been known to the art.

Since the conventional reinforcing tapes use a crystalline synthetic resin film in the surface layer thereof as described above and, therefore, are hard from the material point of view, they cannot be easily shaped by bending in conformity with the shape of the core parts of fastener tapes to which such fitting metal pieces as are used for a separable insertion joint are attached. As a result, it is difficult to impart an accurate outer shape to the core parts of the fastener tapes. The conventional reinforcing tapes pose yet other problems. When they are bent repeatedly, the bent parts thereof ultimately cause whitening possibly to the extent of impairing the overall appearance of the reinforcing tapes. Since their surface layers made of synthetic resin film have a highly glossy surface, the color of the dyed fastener tapes appears in a different tint as seen through the reinforcing tapes.

SUMMARY OF THE INVENTION

It is, therefore, an object of the present invention to eliminate the problems suffered by the conventional slide fasteners as mentioned above.

A more specific object of the present invention is to provide a reinforcing tape for a slide fastener which can be easily shaped in conformity with the outer shape of a core part of a fastener tape intended for attachment thereto of a fitting metal piece and, therefore, easily impart an accurate outer shape to the core part of the fastener tape.

A further object of the present invention is to provide a reinforcing tape and a slide fastener having the reinforcing tape attached thereto at a terminal part thereof, which allow the color of a dyed fastener tape to be seen therethrough faithfully.

A still further object of the present invention is to provide a method of forming a slide fastener tape having a reinforced terminal part.

To accomplish the objects mentioned above, the first aspect of the present invention consists in providing a reinforcing tape for a slide fastener, which comprises a transparent elastomer film and an adhesive layer superposed on the reverse side of the elastomer film.

In accordance with the second aspect of the present invention, there is provided a slide fastener which comprises a pair of dyed fastener tapes each having a row of coupling elements attached to the fastener tape along a longitudinal edge thereof and at least a pair of reinforcing tapes attached to a terminal part of each of the fastener tapes, characterized in that each of the reinforcing tapes comprising a transparent elastomer film and an adhesive layer superposed on the reverse side of the elastomer film is attached by welding or fusion bonding to the terminal part of the dyed fastener tape through the medium of the adhesive layer and has a knurled surface at the welded part.

In accordance with the third aspect of the present invention, there is provided a method of forming a fastener tape having a reinforced terminal part, which comprises the steps of providing a reinforcing tape formed of a transparent elastomer film and an adhesive layer superposed on the reverse side of the eleastomer film, thermally welding the reinforcing tape to a terminal part of a fastener tape through the medium of the adhesive layer, and knurling a surface of the welded part of the reinforcing tape.

In a preferred embodiment of the present invention, a reinforcing tape formed of a transparent polyester elastomer film and a modified polyester film superposed on the reverse side of the elastomer film is thermally welded to the terminal part of a dyed fastener tape formed of woven or knitted synthetic polyester fibers, and the welded part of the reinforcing tape is knurled.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENT

Figure 1:
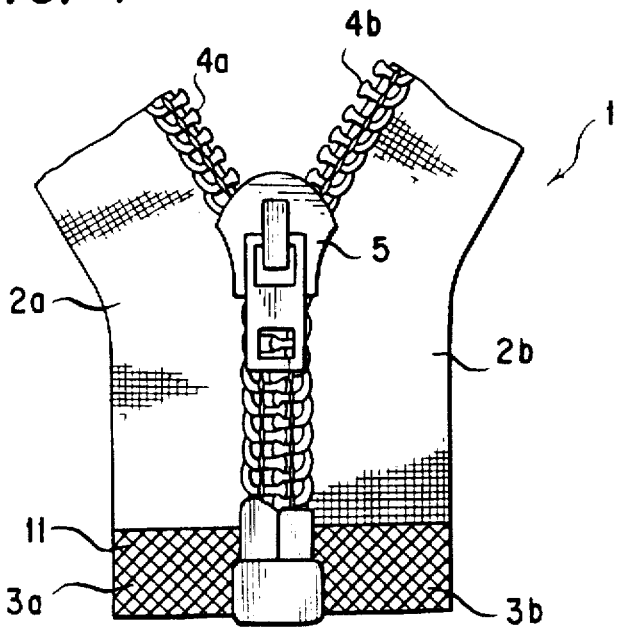
FIG. 1 is a fragmentary plan View showing the lower part of a slide fastener provided with reinforcing tapes of the present invention.
Figure 2:
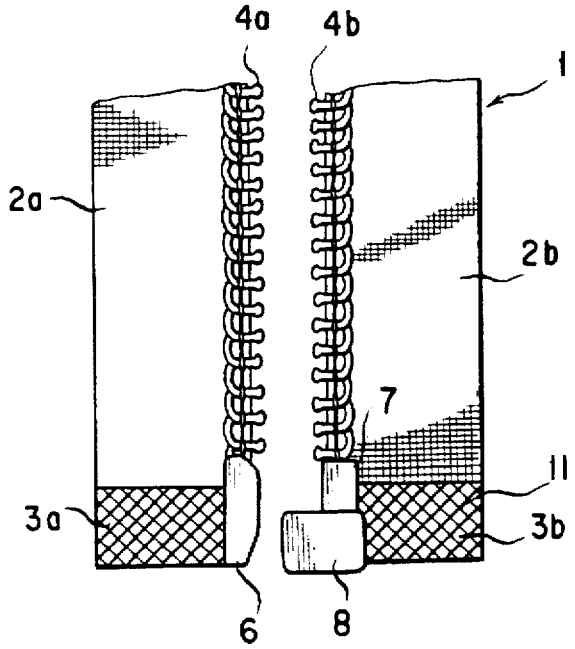
FIG. 2 is a fragmentary plan view showing the lower part of the slide fastener of FIG. 1 held in a separated state.

Now, a preferred embodiment of the present invention will be described below with reference to the accompanying drawings. FIG. 1 and FIG. 2 each show the lower part of a slide fastener 1 having the reinforcing tapes 3*a* and 3*b* of the present invention provided in the parts used for attachment of a separable insertion joint at the lower end parts of a pair of fastener tapes 2*a* and 2*b*. FIG. 2 shows the lower part of the slide fastener which is held in a separated state.

The slide fastener 1 shown in FIG. 1 includes a pair of fastener tapes 2*a* and 2*b*, a pair of reinforcing tapes 3*a* and 3*b* which are welded or fused to the lower end parts of the respective fastener tapes 2a and 2b, rows of coupling elements 4a and 4b, such as spiral coil coupling elements, attached to the inner longitudinal edges of the respective fastener tapes 2a and 2b, a slider 5, and a separable insertion joint or pin-and-box separator composed of an insertion member or hinge bar 6, a box bar 7, and a box member 8, these members being secured to the inner edges of the reinforcing tapes 3a and 3b which are welded to the lower end parts of fastener tapes 2a and 2b. The slider 5 is slidably mounted on the rows of coupling elements 4a and 4b for engaging and disengaging the coupling elements 4a and 4b. FIG. 1 shows the slide fastener 1 in a closed state and FIG. 2 shows it in an opened state.

The fastener tapes 2a and 2b to which the coupling elements 4a and 4b are attached are manufactured by weaving or knitting a fibrous material formed of such synthetic fibers as polyester, nylon, etc. or such natural fibers as cotton. To the lower end parts of the pair of fastener tapes 2a and 2b, the reinforcing tapes 3a and 3b are respectively welded or fused through the medium of an adhesive layer as explained hereinafter. The insertion member 6 which is one of the fitting metal pieces for the separable insertion joint is secured to the inner edge of one, 3a, of the opposed reinforcing tapes and the box member 8 for admitting the insertion member 6 and the box bar 7 therefor are secured to the opposite inner edge of the other, 3b, of the reinforcing tapes. The insertion member 6 is releasably engageable in a slot in the box member 8.

Figure 4:
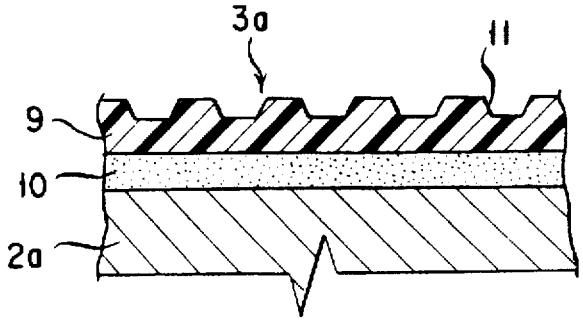
FIG. 4 is an enlarged fragmentary cross-section view of a fastener tape provided with a knurled surface.

The reinforcing tapes 3a and 3b according to the present invention are each formed of two layers as shown in FIG. 4. A surface layer 9 is made of a film of an elastomeric polymer, or an elastomer, of a transparent amorphous highly elastic synthetic resin. Since the elastomer is amorphous and therefore highly elastic, it displays highly satisfactory modulus in flexure and allows easy bending even after adhesion to a fastener tape. Even when it is repeatedly bent, it retains the transparency thereof because the bent part does not cause whitening. The present invention specifically uses a transparent polyester elastomer as the material for the surface layer 9. The surface layer 9 of the elastomer film has a thickness in the range of 150 to 200 μm. It is provided on the reverse side thereof with an adhesive layer 10. A commonly used adhesive agent may be used as the material for the adhesive layer. A hot-melt adhesive is particularly advantageously used as the material for the adhesive film. In the present embodiment, a modified polyester is used as the hot-melt adhesive. It exhibits particularly high adhesiveness when the fastener tapes 2a and 2b are made of polyester fibers. The optimum thickness of the adhesive layer 10 is in the range of 50 to 60 μm.

The reinforcing tapes 3a and 3b are respectively applied fast to the fastener tapes 2a and 2b by fusing the adhesive layer 10 by such hot-pressing means as hot plate pressing or ultrasonic pressing. By knurling the surface layer 9 at the same time that the reinforcing tapes 3a and 3b are welded to the fastener tapes 2a and 2b, knurls 11 are formed at a pitch of not more than 1 mm (0.5 mm optimally) on the surface of the surface layer 9 to erase the surface gloss proper for the synthetic resin film.

Figure 3:
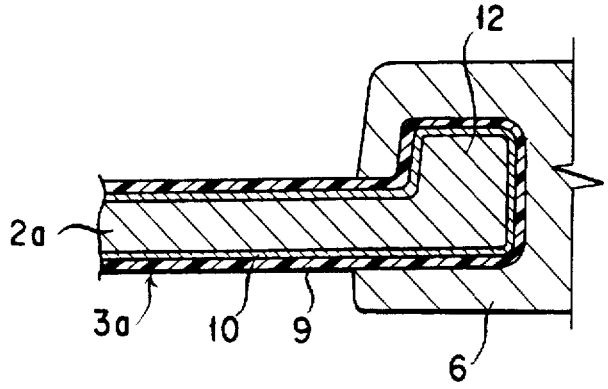
FIG. 3 is a fragmentary cross-section view of the lower end part of a fastener tape provided with a reinforcing tape of the present invention.

FIG. 3 shows a cross section of the portion of the fastener tape 2a which has the reinforcing tape 3a welded thereto and the insertion member 6 further attached thereto. In the inner longitudinal edge of the fastener tape 2a, a protruding core part 12 is formed as with a core cord. The reinforcing tape. 3a is bent inwardly so as to cover the core part 12 and is welded to both the obverse and the reverse side of the fastener tape 2a so as to reinforce the part to which the insertion member 6 is attached. In the lower terminal part of the fastener tape 2b on the opposite side, the box bar 7 of the box member 8 for admitting the insertion member 6 is attached in the same manner as the aforementioned insertion member 6 as shown in FIG. 2, though omitted from illustration in a cross section. In addition to the lower terminal parts to which the separable insertion joint for the fastener tapes 2a and 2b is attached, the reinforcing tapes 3a and 3b may be welded in the upper terminal parts in the same manner as in the lower terminal parts.

The reinforcing tapes 3a and 3b are formed of a transparent elastomer film of elastic polymer. When they are welded or fused to the surfaces of the dyed fastener tapes 2a and 2b, therefore, the color of the fastener tapes is seen faithfully therethrough. Further since the reinforcing tapes 3a and 3b have no conspicuous surface gloss, they appear in substantially the same color as the dyed fastener tapes 2a and 2b and cannot impair the appearance.

As described above, since the reinforcing tape has the surface layer formed of a transparent elastomer film which is more elastic and flexible than most crystalline synthetic resins of the ordinary grade, it allows the core part to which the separable insertion joint is attached to be shaped accurately and easily. Even when the reinforcing tapes of the present invention are repeatedly bent, the bent parts do not cause whitening. Owing to this feature coupled with the meager surface gloss, the reinforcing tapes show the color of the dyed fastener tapes faithfully therethrough and appear to be intimately merged with the fastener tapes and cannot impair the appearance. Since the reinforcing tapes are consequently capable of matching the fastener tapes which generally come in numerous colors, they serve the purpose of obviating the necessity of preparing reinforcing tapes specially matching numerous colors and avoiding the complicated management of inventory.

By thermally welding reinforcing tapes formed of a surface layer of a polyester elastomer film and an adhesive layer of a modified polyester to fastener tapes which are formed of polyester fibers as mentioned above, a slide fastener which is reinforced by the reinforcing tapes possessing such excellent adhesiveness as prevents the adverse phenomena like separation and wear of the reinforcing tapes due to the impacts of the friction of a slider, the laundering, etc. and which produces no feeling of extraneousness of color, therefore, can be obtained.

While a preferred embodiment has been disclosed herein, the invention may be embodied in other specific forms without departing from the spirit or essential characteristics thereof. The described embodiment is therefore to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. A slide fastener comprising a pair of dyed fastener tapes each having a row of coupling elements attached to said fastener tape along a longitudinal edge thereof and at least a pair of reinforcing tapes attached to a terminal part of each of said fastener tapes, wherein the improvement comprises reinforcing tapes each comprising a transparent polyester elastomer film of a thickness in the range of 150 to 200 μm and an adhesive layer formed of a modified polyester film of a thickness in the range of 50 to 60 μm superposed on the reverse side of said film, each reinforcing tape being welded to a terminal part of said dyed fastener tape through the medium of said adhesive layer and having a knurled surface in said polyester elastomer film at the welded part.

2. The slide fastener according to claim 1, wherein said fastener tapes are formed of woven or knitted synthetic polyester fibers.

3. A method of forming a slide fastener having a reinforced terminal part, the method comprising the steps of:

providing a pair of dyed fastener tapes each having a row of coupling elements attached to said fastener tape along a longitudinal edge thereof;

providing at least a pair of reinforcing tapes attached to a terminal part of each of said fastener tapes, said reinforcing tapes each having a transparent polyester elastomer film of a thickness in the range of 150 to 200 μm and an adhesive layer formed of a modified polyester film of a thickness in the range of 50 to 60 μm superposed on the reverse side of said film;

thermally welding each reinforcing tape to a terminal part of said dyed fastener tape through the medium of said adhesive layer; and knurling a surface of said polyester elastomer film at the welded part of said reinforcing tape in order to remove surface gloss.

4. The method according to claim 3, wherein said dyed fastener tapes are formed of woven or knitted synthetic polyester fibers.

5. The method according to claim 3, wherein said knurling step is carried out substantially at the same time that said pair of reinforcing tapes are welded to the terminal part of the fastener tapes.

* * * * *